United States Patent [19]

Beard et al.

[11] Patent Number: 4,668,940

[45] Date of Patent: May 26, 1987

[54] PORTABLE HAZARD WARNING APPARATUS

[75] Inventors: Thomas W. Beard; John R. Pople, England; Terence D. Wright, all of Cumbria

[73] Assignee: Vickers Shipbuilding & Engineering, Cumbria, England

[21] Appl. No.: 645,055

[22] Filed: Aug. 28, 1984

[51] Int. Cl.[4] ..... G08B 19/00

[52] U.S. Cl. ..... 340/521; 340/500; 340/517; 340/632

[58] Field of Search ..... 340/521, 522, 525, 517, 340/500, 506, 632

[56] References Cited

U.S. PATENT DOCUMENTS

| | | | |
|---|---|---|---|
| 4,088,986 | 5/1978 | Boucher | 340/521 |
| 4,204,201 | 5/1980 | Williams et al. | 340/521 |
| 4,319,229 | 3/1982 | Kirkor | 340/521 |
| 4,390,869 | 6/1983 | Christen et al. | 340/521 |

*Primary Examiner*—Donnie L. Crosland

*Attorney, Agent, or Firm*—Mason, Kolehmainen, Rathburn & Wyss

[57] ABSTRACT

Portable electrically operable apparatus for monitoring and for giving warning of the presence of a predetermined environmental hazard in the neighbourhood of the apparatus and which comprises a portable housing, an electrical power source arranged in the housing, a first monitoring unit arranged in the housing and operable to detect the presence of a predetermined environmental hazard e.g. radiation or undesired gases, a second monitoring unit arranged in the housing to monitor the operation of the apparatus for fault detection, a warning indicator arrangement provided on the housing and operated by the first or the second monitoring unit so as to provide a warning indication upon the detection of a predetermined hazard or upon fault detection, and a safe-operation indicator arrangement provided on the housing and connected to the first and second monitoring units so as to provide a safe-operation indication in the absence of hazard detection or fault detection.

7 Claims, 3 Drawing Figures

PORTABLE HAZARD WARNING APPARATUS

Figure 1:
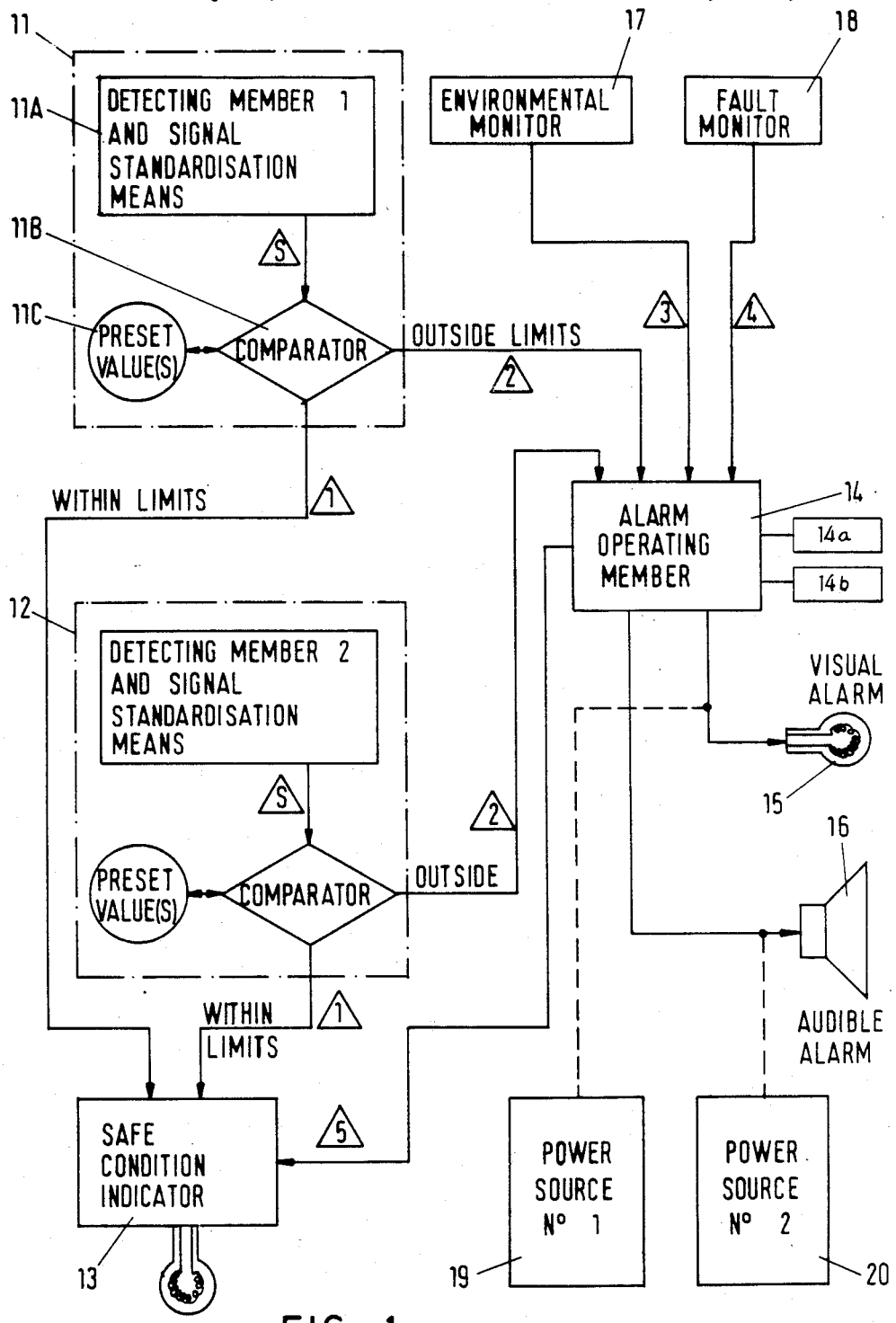

This invention relates to portable apparatus which is electrically operable for monitoring and for giving warning of the presence of a predetermined environmental hazard in the neighborhood of the apparatus.

Enviromental health hazards which are commonly present in industrial processes occur on construction sites such as ships, oil rigs and platforms, or civil engineering works. The range of these hazards covers shortage or excess oxygen, the presence of inert, flammable or poisonous gases, smoke, fire, radiation or flooding.

There are basically three types of enviromental monitor and warning devices, which are as follows:

Type I: Permanently Installed Monitors powered by permanent means, e.g. mains electricity. One example of a system of this type is used at operational nuclear power stations to ensure that radioactive materials are not accidentally removed or allowed to escape from specified areas.

Type II: Individual Monitors worn or carried by each operative entering a potentially hazardous area. Radiation film badges worn by the operatives at nuclear power stations are of this type.

Type III: Stand-alone Monitors powered by internal means, e.g. the Davy Lamp.

This invention is concerned with Type III Stand-alone Monitors.

When a ship, power station or similar structure is under construction, many potentially dangerous manufacturing processes are employed, thereby endangering the workforce. The use of mains-powered permanent monitors is impracticable since long cable runs would be required to every individual confined space, and security of supply could not be guaranteed. The disadvantage with individual monitors is that the operative has to be exposed to the health hazard before the monitor is activated. There thus exists the need for a reliable self-contained stand-alone monitoring and warning device which can be placed in any potentially hazardous environment and is capable of:

(i) operating for an extended period, e.g. several weeks;

(ii) continuously indicating to the operatives, before they enter the enviroment, and during working in the environment that conditions are safe and that the device is functioning correctly;

(iii) giving clear visual and/or audible warning if/when conditions become unsafe or if the device becomes faulty;

(iv) operating its warning alarm(s) over an extended period, so that whenever conditions become unsafe, operatives will be made aware of the danger before entering the hazardous area;

(v) withstanding normal treatment commonplace on construction sites and able to operate its alarms in the event of minor external damage being sustained or a fault developing which would cause the monitor to become unreliable or cease to function.

According to the invention there is provided portable apparatus which is electrically operable for monitoring and for giving warning of the presence of a predetermined environmental hazard in the neighborhood of the apparatus, in which the apparatus comprises:

a detector having a monitoring unit arranged to respond to the presence of a predetermined environmental hazard;

a first indicator arrangement for providing a safe-operation indication or a warning indication depending upon the detection by the monitoring unit respectively of the absence or the presence of the hazard;

and a second indicator arrangement for providing a further warning indication in the event of malfunction of the apparatus sufficient to render the apparatus incapable of monitoring and giving warning of the presence of a hazard.

Preferably, there is a third indicator arrangement for providing a further warning indication in the event of environmental changes occurring which could render the apparatus, or a part(s) of it, incapable of reliably monitoring and giving warning of the presence of a hazard.

In a preferred embodiment, the apparatus comprises:

(i) a robust construction within a sturdy, weatherproof, stable, free-standing housing with prominently placed operational and warning lights visible, yet protected from accidental damage, and/or with audible alarm(s);

(ii) one, or more, monitoring units, the or each unit comprising:

a detecting member (or more than one detecting member if duplication or triplication is required to reduce the risks of giving false alarms), capable of measuring the presence and/or concentration of a potentially hazardous constituent(s) of the environment;

standardization components to correct the signal produced by said detecting member for deviations caused by external environmental factors, e.g. pressure, temperature, relative humidity, etc.;

a comparator capable of comparing the corrected signal from said detecting member with a preset value(s) and, if the corrected signal is within said preset values, generating a first signal or, if the corrected signal is outside said preset value(s), generating a second signal;

a memory unit capable of being programmed or reprogrammed with a preset value(s) which preset value(s) may be accessed by said comparator for comparison purposes;

(iii) A safe condition indicator, forming part of the first indicator arrangement, operable by said first signal, to demonstrate to a remote observer that conditions are safe and that the hazard monitoring and warning device is functioning correctly;

(iv) means for monitoring the state of the environment to detect conditions, e.g. flooding, which would affect the proper functioning of the hazard monitoring and warning apparatus and, when such a condition is detected, of generating a third signal;

(v) means, forming part of the second indicator arrangement for monitoring the serviceability of the hazard monitoring and warning apparatus to detect the occurrence of any fault which would affect its reliable operation and, when such a fault is detected, of generating a fourth signal;

(vi) an alarm operating member, operable by said second, third or fourth signals, to simultaneously deactivate said safe condition indicator via a fifth signal and activate visual and/or audible alarm(s) to warn that either conditions have become unsafe, (said second signal) unquantifiable (said third signal) or a fault has developed within the hazard monitoring and warning device (said fourth signal), wherein once activated, said visual and/or audible alarm(s) will each continue to operate for extended periods of time;

(vii) a plurality of power sources such that:

(i) in the event of failure of one power source, at least one further power source will remain to operate at least one of said visual and/or audible alarms, (ii) adequate power capacity will be available for the hazard monitoring and warming device to function normally for a considerable period of time yet still retain sufficient power reserves to operate its alarm(s) for extended period(s) of time.

Preferably, the alarm operating member is provided with a time delay so that it can differentiate between permanent and transitory conditions.

A power build-up delay may be incorporated so that, after having been switched on, the alarm(s) will be inoperative for a short period to allow said monitoring member to reach the operating condition.

The electrical components and power sources may be sealed into a gas-tight compartment by the use of gaskets and 'O' rings between flanges, said conveniently the electrical components may also be arranged in easily removable modularized form so that, during maintenance and/or repair operations, whole modules, e.g. printed circuit boards, may be simply removed and plugged into an appropriate testing facility where each component and circuit of said whole module can be systematically and automatically checked.

For a clearer understanding of the invention and to show how it may be put into effect, reference will now be made, by way of example only, to the accompanying drawings in which:

FIG. 1 is block diagram of the essential elements and operating logic of one embodiment of hazard monitoring and warning apparatus according to the invention; and FIGS. *2a–2b* are an elevation and plan view of a housing of the apparatus showing external features.

Referring now to the drawings, the apparatus has one, or more, monitoring units 11, 12, each capable of detecting the presence and/or change in concentration of one or more respective predetermined potential environmental health hazards. In this context a "predetermined potential environmental health hazard" refers to, for example, the presence of radiation (e.g. X-rays), poisonous gases (e.g. cyanide), flammable gases (e.g. hydrocarbons), fire or smoke, or the change in concentration of specific gases, e.g. oxygen where a reduced concentration can lead to suffocation and an increased concentration can lead to enhanced fire risk. Monitoring unit 11 will now be described, which consists of several components denoted as 11A, 11B, and 11C. Component 11A is a detecting member, specifically capable of continuously sensing the presence and/or concentration of a particular health hazard(s), and associated with any standardization means required to produce a corrected signal S (FIG. 1), the magnitude of which is directly related to the concentration of the health hazard sensed. The signal S is continuously examined by a comparator 11B against preset value(s) 11C. In the case of a health hazard such as, for example, a poisonous gas or radiation, a single "high" threshold value may be preset, but in the case of, for example, oxygen both "low" and "high" threshold values would be used. If signal S should be withi n the acceptance limit(s), i.e. below the "high" threshold or between the "high" and "low" threshold values as appropriate, the comparator 11B would generate a first signal 1; however, if signal S should be outside the acceptance limit(s), a second signal 2 would be generated instead.

Depending on the particular electrical properties of comparator 11B, only a single output signal may be produced but it could be of two different levels; thus signal 1 could be of a normal level and signal 2 of an abnormal level.

The standardization means used in detector 11A corrects the signal produced directly by said detecting member as it may be influenced by changes in such external factors as, for example, barometric pressure, temperature or relative humidity. The corrected signal, designated S in FIG. 1, may then be used directly by the comparator 11B for comparison with the preset value(s) 11C. Corrected signal S would be fed to the comparator 11B continuously.

If this signal is within the acceptance limit(s), a signal 1 will be generated by comparator 11B and passed to the safe condition indicator 13 where it causes, for example, one or more green light(s) to flash. Green, as one of the recognized colors for safety, is preferred and as a flashing light uses less power than one which is permanently illuminated, this is preferred to economize on power requirements and thus maximize operating life between maintenance requirements. Also, a flashing light is preferred as it attracts attention more readily.

If signal S is outside the acceptance limit(s), comparator 11B generates a signal 2 instead, which is passed to an alarm operating device 14. As no signal 1 was generated, the safe condition monitor 13 ceases to function. Instead, signal 2 causes alarm operating device 14 to operate a visual alarm 15 and/or an audible alarm 16. Once operated, the alarms continue to function until either the power sources run down or, if the health hazard has been removed, an authorized person with a security key (40 FIG. 2) has switched the device off. In this latter event, though the hazard monitoring device would automatically reset itself, it could be a mandatory requirement for the device to be returned to a suitable servicing laboratory, e.g. for replacement of batteries and electronic checks.

The arrangement of the safe condition indicator 13 and alarm operating device 14 is such that they constitute a first indicator device which provides a safe-operation indication or a warning indication depending upon whether the monitoring unit (11, 12) detects respectively the absence or the presence of a hazard.

In the case of some transitory health hazard, e.g. an excessive radiation level, the hazard monitoring and warning device could be arranged to activate its alarms only for the period(s) during which the hazard is present. After the hazard is removed, the hazard monitoring and warning device automatically resets itself and reverts to the normal operating condition. As such a potentially random mode of operation could deplete the power sources 19, 20, an external power source condition indicator (not shown) may be fitted; in any case, once the power sources have been run down below a preset level, the alarms would be permanently activated as part of a fail safe procedure.

The hazard monitoring and warning device is also equipped with an environmental monitor 17. There are certain external influences which could affect the reliable operation of the hazard monitoring and warning device. The following are given as examples of the sorts of external influences which could be monitored here:

(i) Flooding—a water detector, situated low in the body of the hazard monitoring and warning device, to warn of the presence of water before the level has risen sufficiently to cover the detecting member, audible or visual warning alarms or electronic components.

(ii) Temperature or Pressure—certain detecting members 11A may operate reliably only over limited temperature or pressure ranges, i.e. within the design specification.

(iii) Any other influence, either specifically related to a particular detecting member, or which could generally affect the reliability of the hazard monitoring or warning device as a whole or any components of it.

In the event of a detrimental external influence, e.g. flooding, being detected or an external influence, e.g. temperature, pressure, exceeding the design specification, the environmental monitor 17 generates a third signal 3 to activate the alarm operating device 14 and simultaneously deactivate the safe condition indicator (fifth signal 5).

The hazard monitoring device is, in addition, provided with a second indicator arrangement for providing a further warning indication in the event of a malfunction of the apparatus sufficient to render the apparatus incapable of monitoring and giving warning of the presence of a hazard. The second indicator arrangement includes a fault monitor 18 which continuously checks the condition of all or selected components. For example, the condition, e.g. voltage, of each of a plurality of power sources 19, 20, can be monitored either continuously or at regular timed intervals. In the event of a fault being detected, the fault monitor 18 generates a fourth signal 4 to activate the alarm operating device 14 and simultaneously generate a fifth signal 5 to deactivate the safe condition indicator. The fault monitor 18 is one of several "fail safe" features of the hazard monitoring and warning device.

As shown in FIG. 1, a plurality of power sources 19, 20, are used and two are depicted here as an example. It will be seen that power sources 19 and 20 drive the visual and audible alarms 15 and 16 respectively. One of these power sources may also be used to operate the monitoring unit(s) 11, 12, and other electronic components, includng the fault monitor 18; assume, for example, that power source 20 is used and that a fault suddenly develops causing all power to be so that the fault monitor 18 could not operate to generate signal 4. Under these conditions, three fail safe measures are possible:

(i) Fault monitor 18 could be arranged to apply a certain potential to alarm operating member 14 during normal operation but not when a fault was registered, i.e. signal 4 would be the absence of the potential. When no potential is present, alarm operating member 14 is automatically activated. Thus, failure of power source 20 would instantly lead to activation of the remaining operable alarm(s).

(ii) A separate monitor (not shown), driven by power source 19, could continuously check the state of power source 20 (or, if preferred, the presence of signal(s) 1), and, if failure occurred, draw on power source 19 to activate the remaining operable alarm(s), either directly, or via alarm operating member 14.

(iii) Fault monitor 18 could take power from either power source 19 or 20 so that, whichever power source became faulty, power could be drawn from the other power source to activate the remaining operable alarm(s).

Referring to FIG. 1, it will be seen that the monitoring units 11, 12 are contained in chain-dashed boxes. This is intended to indicate that they are replaceable and interchangeable. It is envisaged that the hazard monitoring and warning device would be inside a robust, brightly colored, free-standing portable housing. Inside the housing, the appropriate monitoring unit(s) would be used for each particular situation, but members 13, 14, 15, 16, 17, 18, 19 and 20 could be used for all situations; environmental monitor 17 may be interchangeable for some applications. Thus a whole "family" of hazard monitoring and warning devices could be produced for a variety of applications with a differing monitoring unit, or differing combinations of monitoring units to suit each particular potentially hazardous environment. In this context, "monitoring unit" refers to the detecting member and its signal standardization means 11A, comparator 11B and preset values 11C stored in an accessible memory. As the outputs from each particular monitoring unit would be compatible with the other components of the hazard monitoring and warning device, it would be possible to exchange one (or more) monitoring units and replace them with others; thus a single hazard monitoring and warning device could be adapted to monitor different hazards at different times. In this case, each type of hazard could be identified by a particular colour warning light and distinguishing audible alarm. The case could also be uniquely colored to indicate the hazard(s) being monitored.

Figure 2A:
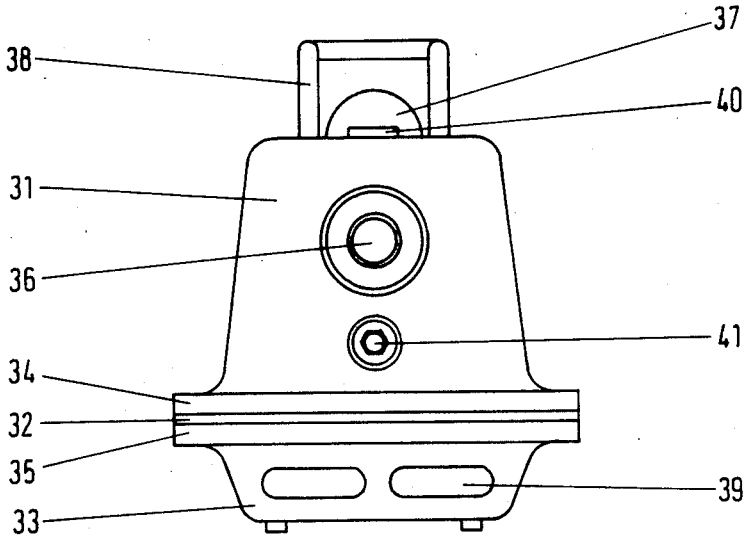
Figure 2B:
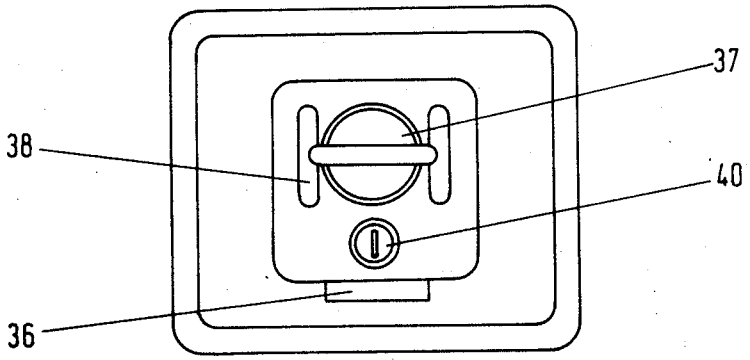

The hazard monitoring and warning device is designed to fit in a housing of distinctive color and shape, for example as shown in FIG. 2. The housing consists of a cover 31, a bulkhead plate 32 and a base 33. Flanges 34 and 35 are integral with cover 31 and base 33 respectively so that cover 31, bulkhead plate 32 and base 33 may be secured together by conventional means, e.g. security bolts or screws (not shown). The overall shape of the housing is that of a truncated pyramid to give an inherently stable structure and a prominent platform at the top for the visible alarms.

On one face of cover 31 is a member 36 which emits an audible alarm. It should be noted that such alarms may be duplicated if required, though as power consumption would be increased, they would sound for a shorter time. Alternatively, if two separate hazards are being monitored simultaneously, audible alarms with distinctive sounds could be used for each hazard. On the top of cover 31, where it is visible from all sides, is a transparent luminaire 37, covering at least one safe condition indicator flashable light and at least one hazard warning indicator flashable light. Luminaire 37 is protected by a handle 38 consisting of two inverted U-shaped side members and a cross member by which the hazard monitoring and warning device may be carried. Handle 38 is constructed of thin tube so that its presence does not hide the flashable lights under the luminaire 37, yet is strong enough to protect the luminaire from accidental damage and permit the apparatus to be chained in a particular location if so desired.

Under the luminaire, transparent plastics members (not shown) may be used to spread the arcs covered by the flashing lights to improve visibility from all sides. The base 33 is constructed from a robust material and is hollow with a plurality of apertures 39 through which the ambient air may circulate. The actual detecting member(s) 11A passes through bulkhead plate 32 and into the hollow inside base 33 where the particular property(ies) of the ambient air passing in and out through apertures 39 is measured. This is the preferred construction for the monitoring of the oxygen concentration level; for monitoring other health hazards, different designs of base 33, with or without apertures 39, may be used with the detecting member(s) 11A placed at appropriate positions in/on the base 33 or cover 31.

A security switch, e.g. key 40, is provided in cover 31. As the hazard monitoring and warning device could be in an environment where flammable gases may be present and the device contains electrical power sources 19,20 which could act as potential sources of ignition, it is necessary to ensure that the potential sources of ignition are in a gas-tight enclosure and separated from the ambient air. To achieve gas-tightness, rubber 'O' seals or gaskets (not shown) are used between cover flange 34 and bulkhead plate 32, between the detecting member(s) 11A and base plate 32 and between cover 31 and the members passing through it, i.e. handle 38, luminaire 37, key 40, and audible alarm 36. To test for leaks, a pressure tapping 41 is used to apply air under pressure; the absence of leaks is shown by the maintenance of a pressure in excess of ambient for a pre-determined time. Tapping 41 is sealed with a bolt and gasket.

The hazard monitoring and warning device is designed for reliable operation over a long period of time with built-in fail safe provisions. However, maintenance is required at the end of each period of service and those requirements have been made as simple as possible. The basic operations would be as follows:

(i) Undo the security bolts or screws (not shown) to separate members 34, 32 and 35.

(ii) Lift off cover 31 and place it alongside base 33—the leads connecting the audible alarm 36 and lights under the luminaire 37 are sufficiently long to permit this.

(iii) Electrical checks: The electrical circuits are assembled on printed circuit boards which can each in turn be removed and plugged into separate test facilities where the integrity of all the circuits and components therein will be automatically checked. Other components, e.g. the audible and visual alarms, would also be checked or, e.g. detecting member(s), replaced where necessary.

(iv) Power Sources: These would be recharged, if rechargeable ones are fitted, or replaced if batteries are used, as preferred. A simple, easy to use battery holder is employed.

(v) The cover 31 would be replaced on the 'O' seal (not shown) and the security bolts or screws replaced to seal flange 34, 32 and 35. Bolt 41 would be unscrewed to allow the connection of the air supply for the pressure testing. When this is completed, bolt 41 with its sealing gasket is replaced.

(vi) As a final check, the hazard monitoring and warning device would be switched on, via security key 40 to check the power build-up delay, normal safe operation and, the operation of the alarms. When these functions have been confirmed, it would be switched off and left for transport to the particular confined space where it is to be used.

As the hazard monitoring and warning device could have been in store for a period of time bfore use, the authorized person would test it by switching on, e.g. with key 40. The tests would cover the power build-up delay, normal operation and alarm operation as described. If all these functions were satisfactory, the device would be switched off and then back on so it would automatically reset itself and could be taken to its specified location.

As one example of the use of the hazard monitoring and warning device described herein, the construction of a ship or submarine may be considered. In such an example large numbers of confined spaces, e.g. tanks and compartments, are present. There are also many cutting and welding operations in which flammable gas mixtures and inert gas, e.g. argon, are used. In the past, there have been many accidents due to leaks of oxygen and flammable gases leading to enhanced fire risk or explosions. Leaks of argon are also dangerous as the gas is heavier than air and so collects in the bottoms of tanks etc. making persons there become drowsy, collapse and suffocate. Current practice to detect for oxygen deficiency is to use a Davy Lamp. In this example, it is necessary to monitor accurately the oxygen content of the air in many confined spaces.

In this example the detecting member, which continuously monitors the oxygen concentration, could be an electrolytic cell. The characteristics of these cells are such that until it has reached its operating condition, it can produce false readings. Thus, when the hazard monitoring and warning device is first switched on a power build-up delay (14*a* on the figure) operates for a predetermined period, to inhibit the alarm operating member 14 reacting to any of these false readings. After the predetermined period, when the cell will have reached the operating condition, the power build-up delay will automatically cut out so that the hazard monitoring and warning device would then operate normally. To indicate the duration of this power build-up delay period, a visual indication would be provided, e.g. the safe condition flashing lights would glow continuously.

In the case of some electrolytic cells, the output signal is directly proportional to the oxygen concentration of the air but in others, the output signal is directly related to the partial pressure of oxygen in the air so that a correction must be applied. In the U.K, barometric pressure usually varies between about 950 to 1050 mb. As oxygen forms about 21% by volume of the atmosphere, the partial pressure could thus vary between 200 and 220 mb. If these were to be used as the preset values 11C for the comparator 11B, no signal $\Delta 2$ would be generated even if the oxygen partial pressure rose to 220 mb when the atmospheric pressure was 950 mb, i.e. 23% $O_2$, or if it fell to 200 mb when the atmospheric pressure was 1050 mb, i.e. 19% $O_2$. It is thus desirable to standardize the signal for variations in the atmospheric pressure to get a corrected signal $\Delta S$ for use by comparator 11B. Variations in the relative humidity also affect the partial pressure, but this effect is not significant here.

The preset values 11C in the accessible memory could be set to any suitable oxygen concentration work levels. As both shortage and excess levels of oxygen are hazardous, both low and high threshold values would be used; these could be typically +18.0% and +23.0% oxygen respectively.

There are certain engineering practices, such as lighting a flammable gas burner in a confined space, where momentary changes in the oxygen concentration could occur. Rather than cause the hazard monitoring and warning device to react to such transitory events, a time delay could be built into the electronics to operate the alarms only if the hazard, as represented by signal 2, was continuously present for a given time interval, say, three seconds; such a time discriminating delay could be incorporated either in comparator 11B or alarm operating device 14 as appropriate it being shown schematically at **14*b* in FIG. 1 to control the device 14**.

Electrolytic cells operate typically over a limited temperature range, e.g. −5° C. to +40° C. The cells will not detect changes in atmospheric oxygen if covered by water. Thus, the environmental monitor 17 would generate signal 3 if the temperature went outside the operating range, or if the presence of water was detected near the cell.

The alarms would both operate for extended periods if activated. For example, the visual alarm could continuously flash its red warning lights for a minimum of 24 hours and the audible alarm could continuously sound for seven days. This would ensure that, other than after major holidays, at least one alarm would still be operating at the start of every shift irrespective of when the hazard occurred, e.g. if conditions became unsafe after work finished on the Friday evening before a Bank Holiday weekend, the audible alarm would still be operating when the workers returned on the following Tuesday morning. In order to ensure this level of safety, the fault monitor 18 would continuously measure the voltage of power sources 19, 20; if the voltages fell below certain preset levels, fault monitor 18 would generate signal 4 to activate alarm(s) 15,16. In addition to the alarm requirements, power supplies should be adequate for an extended operational period, e.g. four weeks, between maintenance operations.

In addition to the basic principle disclosed above, certain additional features could be desirable in specific applications, for example:

(i) As the monitoring members cannot be 100% reliable, the changes of false alarms due to failure of a member may be reduced if two (or more) monitoring members are used in parallel and the alarm operating member 14 is arranged to act only if both (or more) of the signals 2 are received. Alternatively, if two or more such members are used, a signal from one, or a majority verdict, could be taken as being the true indication of the parameter being measured.

(ii) A radio transmitter could be included to send a uniquely coded signal to a central point when an alarm had been activated, thus alerting the Safety and Rescue Teams immediately. Signals indicating safe conditions could also be sent, if required. Two-way radio transmissions could be used to allow interrogation of the hazard monitoring and warning device to determine the battery state.

(iii) Erasable memories could be included to record the value of corrected signal S, environmental monitor state signal 3 and the fault monitor state, signal 4 at (say) hourly intervals so that, if a hazard developed, the progressive build-up of the hazard could subsequently be followed and the cause more easily identified. If the hazard would be likely to develop quickly, warning levels could be programmed with the preset values 11C to start recording the values of signal S etc. once this level had been reached. This recording of signals could also be done centrally via the radio transmitter.

(iv) If audible alarm 16 was particularly loud, its sudden activation could cause an adverse reaction, e.g. heart attack, in a worker situated close to the hazard monitoring and warning device. In this case, a two-stage alarm which progressively increased the level of sound output could be preferred.

We claim:

1. Portable electrically operable apparatus for monitoring and for giving warning of the presence of a predetermined environmental hazard in the neighborhood of the apparatus, said apparatus comprising:

a portable housing;

an electrical power source arranged in the housing;

a first monitoring unit arranged in the housing and including at least one detector for responding to the presence of a predetermined environmental hazard;

a second monitoring unit arranged in the housing to monitor the operation of the apparatus for fault detection;

a warning indicator arrangement provided on the housing and which is connected to the first monitoring unit and to the second monitoring unit, the indicator arrangement being operable to provide a warning indication upon the detection of a predetermined hazard by the first monitoring unit or upon fault detection by the second monitoring unit; and a safe-operation indicator arrangement provided on the housing and connected to the first monitoring unit and to the second monitoring unit, and operable to provide a safe-operation indication in the absence of hazard detection or fault detection by the first and second monitoring units respectively.

2. Apparatus according to claim 1, including a third monitoring unit arranged in the housing and operable to respond to predetermined environmental changes taking place which could render at least part of the apparatus incapable of reliably monitoring and giving warning of the presence of a hazard, the third monitoring unit being connected to the warning indicator arrangement so as to initiate a warning indication when a predetermined environmental change takes place.

3. Apparatus according to claim 1, in which the first monitoring unit is capable of detecting the presence and/or change in concentration of at least one of: radiation, poisonous gases, inflammable gases, fire, smoke, and change in concentration of specific gases.

4. Apparatus according to claim 1, in which:

(1) a free-standing housing forms said portable housing;

(2) the detector of the first monitoring unit comprises a detecting member capable of measuring the presence and/or concentration of a potentially hazardous constituent of the environment, a standardization component to correct the signal produced by the detecting member for deviations caused by external environmental factors, a comparator capable of comparing the corrected signal from the detecting member with a preset value and, if the corrected signal is within the preset value, generating a first signal or, if the corrected signal is outside the present value generating a second signal, and a memory unit capable of being programmed or re-programmed with a preset value, which preset value may be accessed by said comparator for comparison purposes;

(3) an environmental monitoring unit is arranged in the housing and is connected to said indicator arrangement, said unit having means for detecting conditions which would affect the proper functioning of the apparatus and, when such a condition is detected, for generating a third signal;

(4) means is provided in the second monitoring unit for monitoring the serviceability of the apparatus to detect the occurrence of any fault which would affect its reliable operation and, when such a fault is detected, for generating a fourth signal;

(5) an alarm operating member, operable by said second, third or fourth signals, is arranged simultaneously to de-activate said safe-operation indicator arrangement via a fifth signal and activate visual and/or audible alarm to warn that either conditions have become unsafe, unquantifiable or a fault has develped within the apparatus and wherein, once activated, said visual and/or audible alarms will each continue to operate for extended periods of time; and (6) a plurality of power sources are arranged in the housing in such a way that:

a. in the event of failure of one power source, at least one further power source will remain to operate at least one of said visual and/or audible alarms; and b. adequate power capacity will be available for the apparatus to function normally for a considerable period of time yet still retain sufficient power reserves to operate its alarms for extended periods of time.

5. Apparatus according to claim 4, in which the alarm operating member is provided with a time delay so that it can differentiate between permanent and transitory conditions.

6. Apparatus according to claim 4, including a power build-up delay arrangement for rendering the alarm inoperative for a short period to allow the detecting member to reach an operating condition.

7. Apparatus according to claim 1, in which the electrical components thereof are arranged in the housing in easily removable modular form.

* * * * *